US011059636B2

(12) United States Patent
Maeda

(10) Patent No.: US 11,059,636 B2
(45) Date of Patent: Jul. 13, 2021

(54) DISCHARGE CONTAINER

(71) Applicant: YOSHINO KOGYOSHO CO., LTD., Tokyo (JP)

(72) Inventor: Shinya Maeda, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/320,066

(22) PCT Filed: May 23, 2017

(86) PCT No.: PCT/JP2017/019251
§ 371 (c)(1),
(2) Date: Jan. 23, 2019

(87) PCT Pub. No.: WO2018/020800
PCT Pub. Date: Feb. 1, 2018

(65) Prior Publication Data

US 2019/0270554 A1 Sep. 5, 2019

(30) Foreign Application Priority Data

Jul. 28, 2016 (JP) ..... JP2016-148728

(51) Int. Cl.
*B65D 47/06* (2006.01)
*B65D 47/20* (2006.01)
(Continued)

(52) U.S. Cl.
CPC ..... *B65D 47/2056* (2013.01); *B65D 47/0838* (2013.01); *B65D 47/20* (2013.01); *B65D 51/1661* (2013.01)

(58) Field of Classification Search
CPC ..... B65D 47/2056; B65D 47/0838; B65D 47/20; B65D 51/1661; B65D 47/2018;
(Continued)

(56) References Cited

U.S. PATENT DOCUMENTS 3,081,006 A * 3/1963 Land ..... B65D 47/2018 222/212
3,833,154 A * 9/1974 Markowitz ..... B65D 1/0292 222/212
(Continued)

FOREIGN PATENT DOCUMENTS

JP H08-242833 A 9/1996
JP 2001106263 A 4/2001
(Continued)

OTHER PUBLICATIONS

Jan. 29, 2019 International Preliminary Report on Patentability issued in International Patent Application No. PCT/JP2017/019251.
(Continued)

*Primary Examiner* — Vishal Pancholi
*Assistant Examiner* — Robert K Nichols, II
(74) *Attorney, Agent, or Firm* — Oliff PLC

(57) ABSTRACT

A discharge container includes: a double-walled container body including an inner layer body and an outer layer body; a discharge cap having a discharge outlet, the discharge cap being attached to a mouth of the double-walled container body; and a check valve structure. The check valve structure has a tubular partition wall defining a flow path of the content and a valve body which is provided on the partition wall with a hinge portion and has a single swing structure, and space inside the partition wall rather on the discharge outlet side than on the valve body side serves as a liquid reservoir space where part of remaining content is stored after the discharge of the content.

11 Claims, 1 Drawing Sheet

(51) Int. Cl.
*B65D 47/08* (2006.01)
*B65D 51/16* (2006.01)

(58) Field of Classification Search
CPC ..... B65D 35/16; B65D 47/44; B65D 47/32; B65D 83/0055; B65D 23/02; A61M 3/0266
USPC ..... 222/94, 212, 494, 491, 95, 105, 107, 222/386.5, 209; 137/855
See application file for complete search history.

(56) References Cited

U.S. PATENT DOCUMENTS

| | | | | |
|---|---|---|---|---|
| 4,903,867 | A * | 2/1990 | Mettenbrink | B05B 11/3032 222/207 |
| 5,332,121 | A | 7/1994 | Schmidt et al. | |
| 5,458,274 | A | 10/1995 | Maietta | |
| 6,332,726 | B2 * | 12/2001 | Yamamoto | A45D 19/02 401/183 |
| 6,575,330 | B2 * | 6/2003 | Rousselet | B65D 47/2018 222/1 |
| 7,044,334 | B2 * | 5/2006 | Mita | B65D 35/14 222/105 |
| 9,237,790 | B2 * | 1/2016 | Takagi | A45D 19/02 |
| 2013/0200099 | A1 | 8/2013 | Abe | |
| 2016/0145015 | A1 * | 5/2016 | Hoshino | B65D 83/0055 222/130 |

FOREIGN PATENT DOCUMENTS

| | | | |
|---|---|---|---|
| JP | 2002-068263 | A | 3/2002 |
| JP | 2006-223169 | A | 8/2006 |
| JP | 2014-105016 | A | 6/2014 |
| JP | 2015-127215 | A | 7/2015 |

OTHER PUBLICATIONS

Jul. 18, 2017 International Search Report issued in International Patent Application No. PCT/JP2017/019251.
Aug. 26, 2019 Office Action issued in Australian Patent Application No. 2017304845.
May 20, 2019 Office Action issued in Australian Patent Application No. 2017304845.
Dec. 13, 2019 Office Action issued in Australian Patent Application No. 2017304845.
Dec. 13, 2019 Office Action issued in Canadian Patent Application No. 3,031,378.
Jan. 14, 2020 Office Action issued in Japanese Patent Application No. 2016-148728.
Jan. 17, 2020 Office Action issued in Korean Patent Application No. 10-2019-7001950.
Mar. 11, 2020 Extended European Search Report issued in European Patent Application No. 17833811.7.
Mar. 11, 2020 Office Action issued in Chinese Patent Application No. 201780046233.7.
Mar. 17, 2020 Office Action issued in Australian Patent Application No. 2017304845.
Apr. 29, 2020 Office Action issued in Canadian Patent Application No. 3,031,378.
Oct. 18, 2019 Office Action issued in Chinese Patent Application No. 201780046233.7.
Jun. 24, 2020 Office Action issued in Korean Patent Application No. 10-2019-7001950.
Aug. 12, 2020 Office Action issued Korean Patent Application No. 10-2019-7001950.
Nov. 2, 2020 Office Action issued in Chinese Patent Application No. 201780046233.7.
Oct. 29, 2020 Office Action issued in Canadian Patent Application No. 3,031,378.
Mar. 25, 2021 Office Action issued in Chinese Patent Application No. 201780046233.7.

* cited by examiner

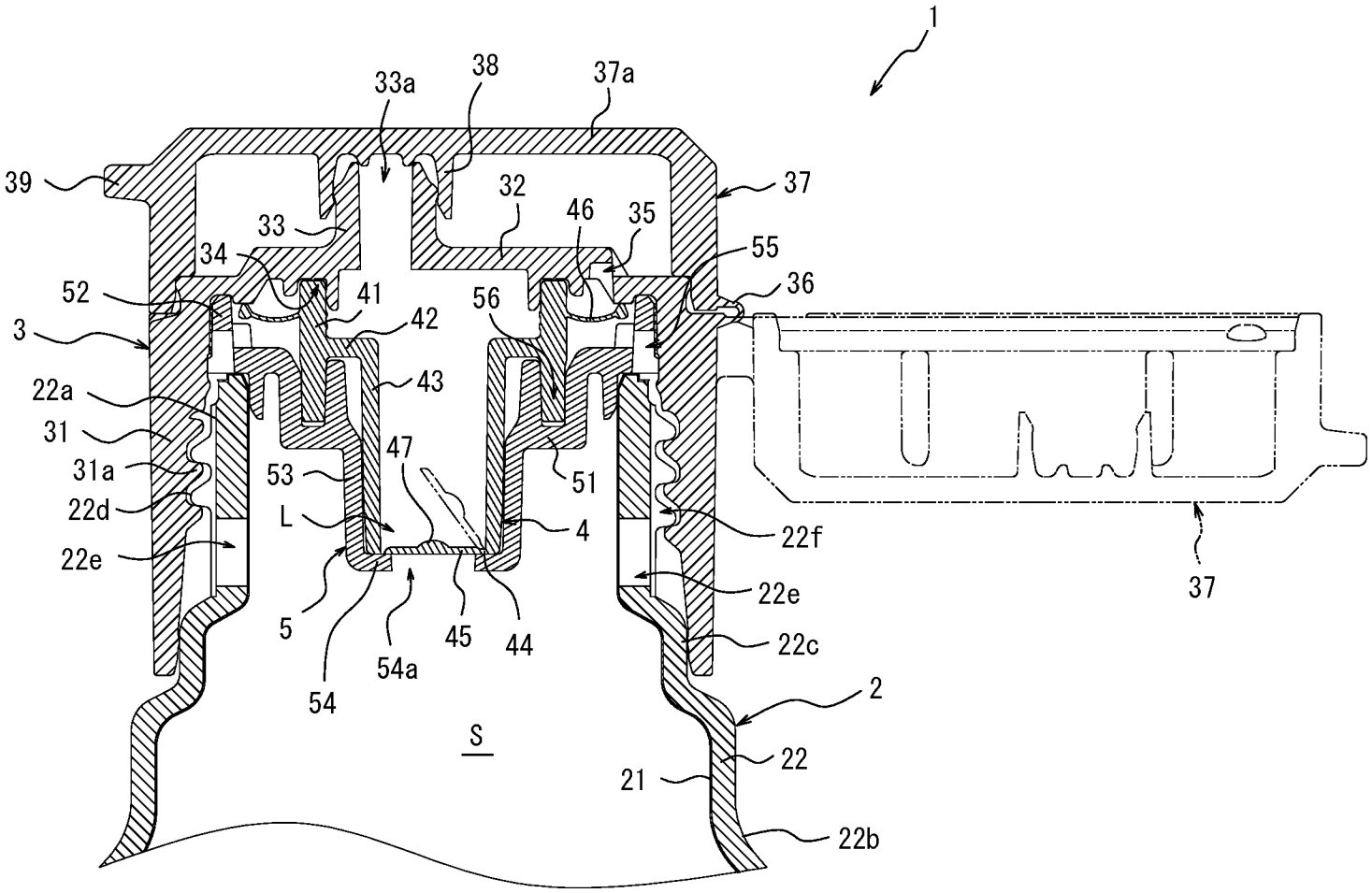
1
37
37a
38
33a
39
55
36
35
46
32
33
34
52
3
22a
31
31a
22d
22e
22f
22e
22c
2
22
22b
21
51
4
56
44
45
54a
47
42
43
41
53
L
5
54
S

DISCHARGE CONTAINER

TECHNICAL FIELD

The present disclosure relates to a discharge container that contains a content in a double-walled container body having an inner layer and discharges the content from a discharge outlet of a discharge cap attached to a mouth, and in particular relates for example to a discharge container containing a relatively highly viscous content containing some solid content, such as sauce or miso.

BACKGROUND

Conventionally, a discharge container is known, which is configured such that a discharge cap is attached to a mouth of a container body containing a content and the content contained in the container body can be discharged from a discharge outlet of the discharge cap by pushing (squeezing) a trunk of the container body.

Further, as such a discharge container, one configured such that a valve body is provided inside a discharge cap to allow a flow of a content from a container body toward a discharge outlet while preventing backflow of the content from the discharge outlet toward the container body and preventing a flow of ambient air from the discharge outlet side into the container body.

For example, JP 2014-105016 A (PTL 1) describes a container in which a container body includes an outer layer body (outer container) and an inner layer body (inner container) that is deformable in a volume-reducing manner and is held inside the outer layer body, and a check valve (valve body) having a three-point support structure that opens and closes a flow path of the content is provided inside the discharge cap (dispensing plug).

Using a discharge container having such a structure, when a content is discharged by squeezing the trunk of the container (squeezing) and then the squeeze on the trunk is released, while the check valve prevents the content or the ambient air from being flown from the discharge outlet into the container body, the original shape of the outer layer body can be recovered with the inner layer body being deformed in a volume-reducing manner by introducing the ambient air into the space between the outer layer body and the inner layer body from the intake hole provided in the discharge cap. With such a structure, the content can be discharged without being replaced with the ambient air. Accordingly, the content left inside the container body is hardly exposed to the air, which can retard spoilage and deterioration of the content.

CITATION LIST

Patent Literature

PTL 1: JP 2014-105016 A

SUMMARY

Technical Problem

Here, the discharge container as described above is often used in applications of containing a liquid content such as soy sauce or cosmetics; however, there is also a demand for discharge containers which can be used in applications of containing a relatively highly viscous content containing some solid content, such as sauce or miso.

However, when the discharge container as described above is used, the solid content contained in the content would be caught in a clearance of the check valve, thus the check valve would not close, the ambient air would enter the containment space through the open check valve, and so the content would be spoiled or deteriorated. Further, in the case of a highly viscous content, the check valve having a three-point support structure (three-piece valve structure) as described above hardly opens and would require excessive force for squeezing.

It could therefore be helpful to provide a discharge container of which check valve structure normally works so that spoilage and deterioration of the content due to the entry of ambient air into the containment space can be retarded even when the container contains a relatively highly viscous content containing some solid content.

Solution to Problem

The present disclosure is to solve the above problem, and to discharge container of the present disclosure includes: a double-walled container body including an inner layer body which defines a containment space for a content and is deformable in a volume-reducing manner and an outer layer body surrounding the inner layer body; a discharge cap having a discharge outlet through which the content is discharged, the discharge cap being attached to a mouth of the double-walled container body; and a check valve structure which is disposed inside the discharge cap and allows a flow of the content from the containment space toward the discharge outlet and prevents backflow from the discharge outlet toward the containment space. The check valve structure has a tubular partition wall defining a flow path of the content from the containment space toward the discharge outlet and a valve body which is provided on the partition wall with a hinge portion and has a single swing (half-swing) structure swung on the hinge portion, and space inside the partition wall rather on the discharge outlet side than on the valve body side serves as a liquid reservoir space where part of remaining content is stored after the discharge of the content.

Further, the discharge container of the present disclosure preferably includes a valve member having the partition wall and the valve body, and a valve retaining member retaining the valve member inside the discharge cap.

For the discharge container of the present disclosure, the viscosity of the content is preferably 100 mPa·s or more.

Further, for the discharge container of the present disclosure, the diameter of a piece of solid content contained in the content is preferably less than 1.5 mm.

Advantageous Effect

The present disclosure provides a discharge container of which check valve structure normally works so that spoilage and deterioration of the content due to the entry of the ambient air into the containment space can be retarded even when the container contains a relatively highly viscous content containing some solid content.

BRIEF DESCRIPTION OF THE DRAWINGS

In the accompanying drawing, FIG. 1 is a side view of a discharge container of one embodiment of the present disclosure.

DETAILED DESCRIPTION

One embodiment of the present disclosure will now be described with reference to the drawing. As depicted in FIG.

1, a discharge container 1 of this embodiment includes a double-walled container body 2, a discharge cap 3 attached to the double-walled container body 2, a valve member 4, and a valve retaining member 5. Note that in the description, the claims, the abstract, and the drawing, the side where a cap body 37 to be described is situated is the upper side (upper side in FIG. 1), and the side where the double-walled container body 2 is situated is the lower side (lower side in FIG. 1).

The double-walled container body 2 includes an inner layer body 21 and an outer layer body 22. The double-walled container body 2 in this embodiment can be formed by biaxial stretch blow molding of a preform shaped like a test tube, in which a synthetic resin material of the inner layer body 21 and a synthetic resin material of the outer layer body 22 are stacked. However, the method of forming the double-walled container body is not limited to this. For example, the double-walled container body 2 may be formed by extrusion blow molding a cylindrical multi-layer parison formed by stacking a synthetic resin material of the inner layer body 21 and a synthetic resin material of the outer layer body 22. In addition, the double-walled container body 2 is not necessarily a delamination container, and may be formed by assembling the outer layer body 22 and the inner layer body 21 which have been separately formed.

As a material of the inner layer body 21 included in the double-walled container body 2, ethylene vinyl alcohol copolymer (EVOH) or nylon is used. Further, as a material of the outer layer body 22, low density polyethylene (LDPE) or high density polyethylene resin (HDPE) is used. In particular, when LDPE is used, high squeezability of the container can be obtained. However, without limitation to this aspect, for example, when a delamination container is formed by biaxial stretch blow molding, the inner layer body 21 may use polypropylene (PP) as a material, and the outer layer body 22 may use polyethylene terephthalate (PET) as a material. Further, as materials of the inner layer body 21 and the outer layer body 22, other resins having low compatibility with each other can be used.

The inner layer body 21 is formed to be deformable in a volume-reducing manner, and in this embodiment, the inner layer body 21 can be obtained by being delaminated from the outer layer body 22 of the double-walled container body 2 formed in a stacked manner. The inner layer body 21 defines a containment space S where a content is contained inside. Note that between the inner layer body 21 and the outer layer body 22, an adhesive strip can be provided which extends vertically and partially bonds the inner layer body 21 and the outer layer body 22.

The outer layer body 22 may have a bottle shape having a cylindrical mouth 22*a*, a restorable flexible trunk 22*b*, and a bottom that stops the lower end of a trunk 22*b*. A region ranging from the mouth 22*a* to the trunk 22*b* may is provided with a sealing step portion 22*c* having a larger diameter than an upper end portion of the mouth 22*a*.

Further, as depicted in FIG. 1, an outer circumferential surface of the mouth 22*a* is provided with a male threaded portion 22*d*. Further, the mouth 22*a* is provided with a through hole 22*e* for taking air to and from the space between the outer layer body 22 and the inner layer body 21 and the outer layer body 22, and the outer circumferential surface of the mouth 22*a* is provided with a groove portion 22*f* which forms a vertical cutout in the male threaded portion 22*d*.

In this embodiment, the groove portion 22*f* forming a vertical cutout in the male threaded portion 22*d* is adapted to be used as a ventilation path; however, the present disclosure is not limited to this aspect. Instead of providing the groove portion 22*f*, a clearance between the male threaded portion 22*d* and a female threaded portion 31*a* may be used as a ventilation path.

The discharge cap 3 includes an outer circumferential wall 31 surrounding the mouth 22*a*, and the female threaded portion 31*a* corresponding to the male threaded portion 22*d* of the mouth 22*a* is formed on an inner circumferential surface of the outer circumferential wall 31. Further, a top wall 32 is integrally connected to the upper end of the outer circumferential wall 31. Further, the top wall 32 is provided with a discharge tube 33 for a content, which tube forms a discharge outlet 33*a*. A lower surface of the top wall 32 is provided with a ring-shaped upper fitting groove 34. Moreover, an ambient air introduction hole 35 extending through the top wall 32 is provided on the radially outside of the upper fitting groove 34. Note that a lower part of the outer circumferential wall 31 abuts the entire circumference of the sealing step portion 22*c* in an airtight manner.

The discharge cap 3 has the cap body 37 provided to be openable and closable using the hinge 36. The cap body 37 is formed like a closed-topped tube having a diameter similar to the diameter of the discharge cap 3, and the cap body 37 is connected to the outer circumferential wall 31 using the hinge 36 so as to cover the discharge tube 33. A ceiling wall 37*a* of the cap body 37 is provided with a tubular sealing wall 38 extending downward, and when the cap body 37 is closed, the sealing wall 38 fits to the outside of the discharge tube 33 to close the discharge outlet 33*a*. A lug portion 39 is provided on the cap body 37 on the side opposite to the hinge 36 so as to be caught by a finger for an opening operation on the cap body 37. Note that in this example, the discharge tube 33 is provided in a position deviated from the center of the top wall 32 to the opposite side of the hinge 36; however, the position is not limited to this, and the discharge tube 33 can be provided at a central position of the top wall 32.

The valve member 4 is retained in the discharge cap 3 using the valve retaining member 5 installed inside the discharge cap 3. Here, the valve retaining member 5 is made of a synthetic resin and includes a partition wall portion 51 placed to cover the upper opening of the inner layer body 21, and an outer tube portion 52 standing from the outer periphery of the partition wall portion 51. A tubular retainer tube 53 is provided on the partition wall portion 51, and an end portion of the retainer tube 53 is provided with a ring wall 54 shaped like a flange inclined radially inside. An opening 54*a* serving as a flow path of a content is formed in the ring wall 54. The ring wall 54 serves as a valve seat portion for the valve body 45 to be described, and the outer peripheral portion of the valve body 45 abuts the entire circumference of the upper surface of the ring wall 54, thus the opening 54*a* is closed. A vent hole 55 serving as an air flow path is formed in an outer peripheral portion of the partition wall portion 51. A ring-shaped lower fitting groove 56 is provided on the upper surface of the partition wall portion 51.

The valve member 4 is formed from a soft material such as for example rubber or elastomer, and is elastically deformable. In this example, the valve member 4 is formed from low density polyethylene (LDPE). The valve member 4 includes a cylindrical base portion 41, a ring-shaped flange portion 42 provided inside the base portion 41, a cylindrical partition wall 43 hanging down from the inner periphery of the flange portion 42, and the valve body 45 which is provided on the partition wall 43 with a hinge portion 44 and has a single swing structure swung on the hinge portion 44.

The partition wall 43 is placed inside the retainer tube 53, and defines a flow path of content from the containment space S to the discharge outlet 33*a*. Further, space inside the partition wall 43, rather on the discharge outlet 33*a* side than on the valve body 45 side serves as a liquid reservoir space L where part of remaining content is stored after the discharge of the content. Thus, the partition wall 43, the valve body 45, and the ring wall 54 serving as a valve seat portion form a check valve structure which allows a flow of the content from the containment space S toward the discharge outlet 33*a* and prevents backflow from the discharge outlet 33*a* toward the containment space S.

In this example, as depicted in FIG. 1, the valve body 45 is formed like a disk having larger diameter than the opening 54*a* of the ring wall 54 serving as a valve seat portion, and the valve body 45 is integrally connected to an inner circumferential surface of the partition wall 43 using the hinge portion 44 constituted by a single coupling piece. The valve body 45 swings up and down on the hinge portion 44 by being supported on the partition wall 43 at one point by the hinge portion 44. Thus, the valve body 45 has a so-called single-point swing structure; however, the present disclosure is not limited to this. For example, another single swing structure may be used in which the hinge portion 44 is constituted by two or more coupling pieces connecting the partition wall 43 and the valve body 45, and the valve body 45 swings on the plurality of coupling pieces.

As depicted in FIG. 1, a lower surface of the valve body 45 abuts the entire circumference of the upper surface of the ring wall 54 in a normal state (closed state), so that the opening 54*a* is closed, and the ambient air etc. is prevented from flowing from the discharge outlet 33*a* side into the containment space S. On the other hand, when the trunk 12 is squeezed and the containment space S is pressurized, as indicated by a dash dot dot line in FIG. 1, the valve body 45 swings on the hinge portion 44 so as to move upward away from the upper surface of the ring wall 54, thus the valve body 45 opens the opening 54*a*. Accordingly, the valve body 45 is swingable between a closed position where the opening 54*a* is closed and an open position where the opening 54*a* is opened.

Note that an outer circumferential surface of the base portion 41 is integrally provided with an ambient air introduction valve 46 which is in resilient contact with the lower surface of the top wall 32 to close the ambient air introduction hole 35 in a normal state, and moves away from the lower surface of the top wall 32 to communicate the ambient air introduction hole 35 to the through hole 22*e* when the pressure between the outer layer body 13 and the inner layer body 14 is low. In the illustrated example, the ambient air introduction valve 46 is formed to have a thin ring shape from the same material as the partition wall 43, and is adapted to be in resilient contact with the lower surface of the top wall 32 on its outer periphery.

Further, a hemispherical projection 47 is integrally provided on the center of an upper surface of the valve body 45, and the projection 47 allows the outer peripheral portion of the valve body 45 to abut the ring wall 54 serving as a valve seat portion while ensuring a certain rigidity.

When a content is discharged using the discharge container 1, the cap body 37 is opened and the discharge container 1 is brought into an inverted position, and the trunk 22*b* is then squeezed. The content in the containment space S pressurized by squeezing the trunk 22*b* pushes open the valve 45 and passes through the opening 54*a* and the liquid reservoir space L inside the partition wall 43, and is discharged from the discharge outlet 33*a* through the discharge tube 33. In this manner, the content contained in the containment space S can be discharged. After the content is discharged, when the squeeze is released, the valve body 45 returns to the original position, and the valve body 45 abuts the upper surface of the ring wall 54 serving as a valve seat portion to close the opening 54*a*. At this point of time, part of the content left without being discharged is stored in the liquid reservoir space L, thus a liquid seal is formed. Further, even in the case where solid content contained in the content is caught between the valve body 45 and the ring wall 54, and the opening 54*a* cannot be completely closed, the content remains in the liquid reservoir space L due to the surface tension or the viscosity of the content; the content covers the inside of the partition wall, so that the content serves as a sealant to cover the inside of the partition wall 43 above the valve body 45. Therefore, the ambient air from the discharge outlet 33*a* does not enter the containment space S through the liquid reservoir space L. Note that the present disclosure can be used in applications of containing contents containing some solid content, including, for example, sauces such as pasta sauce, pizza sauce, and pork cutlet sauce; ketchup; mayonnaise; and chunky liquid seasonings such as dressing and liquid miso. In particular, when a relatively highly viscous content is contained, more reliable liquid sealing can be achieved, which is a significant effect.

More specifically, the viscosity of the content is preferably 100 mPa·s or more. The viscosity of the content was measured using a Brookfield viscometer manufactured by TOKYO KEIKI INC. (using a No. 2 rotor, rotation speed: 60 rpm, after 20 s, room temperature) under conditions where solid content was dispersed in the content.

Further, a piece of solid content contained in the content is preferably less than 1.5 mm in diameter. Thus, the content easily stays in the liquid reservoir space L even when solid content is caught between the valve body 45 and the ring wall 54 and the opening 54*a* is not completely closed, which ensures that liquid sealing can be formed more reliably. Accordingly, the functionality of the check valve structure can be prevented from being reduced for a long period of time. From a similar point of view, a piece of solid content contained in the content is more preferably 1 mm or less in diameter.

Note that in this embodiment, the valve body 45 which had a single swing structure and was provided on the partition wall 43 with the hinge portion 44 was used as the check valve structure. The valve body 45 having a single swing structure opens wider than three-point support valve structure, so that even when the viscosity of the content is relatively high, excessive force is not required for squeezing and the content can easily be discharged.

The technical scope of the present disclosure is not limited to the above embodiment, and various modifications can be made without departing from the spirit of the present disclosure. For example, in the above embodiment, the valve body 45 and the partition wall 43 are integrally formed from the same material; however, without limitation to this, a valve body formed as a separate body can be swingably assembled with the partition wall 43.

Further, in the above embodiment, the discharge cap 3 is threadedly engaged with the mouth 22*a* of the double-walled container body 2; however, without limitation to this, for example, engagement portions allowing for mutual undercut engagement may be provided and may be engaged by capping etc. Moreover, in the above embodiment, the cap body 37 opens and closes around the hinge 36; however, without limitation to this, the cap body 37 may be threadedly engaged with the discharge cap 3 by screw engagement.

Further in the foregoing embodiment, the ambient air introduction hole 35 is provided on the top wall 32 of the discharge cap 3, and the ambient air introduction hole 35 is opened and closed using the ambient air introduction valve 46 projecting from the base portion 41 of the base valve member 4; and the vent hole 55 serving as an air flow path is formed in an outer peripheral portion of the valve retaining member 5. However, this disclosure is not limited to this aspect. For example, instead of providing the ambient air introduction valve 46, the air flow path from the ambient air introduction hole 35 to the through hole 22*e* may be partly narrowed to make the air between the outer layer body 22 and the inner layer body 21 difficult from leaking out. This structure can achieve both appropriate content discharge functions in squeezing and ambient air admission functions in releasing the squeeze. Alternatively, a hole for introducing ambient air may be formed in the trunk 22*b* or the bottom of the double-walled container body 2 and a valve body that opens and closes the hole may be provided to achieve another structure in which ambient air is introduced into the space between the outer layer body 22 and the inner layer body 21. Further, when a pinched-off portion is formed in the bottom of the double-walled container body 2, ambient air may be introduced into the space between the outer layer body 22 and the inner layer body 21 for example through a slit provided in the pinched-off portion.

REFERENCE SIGNS LIST

1 Discharge container
2 Double-walled container body
3 Discharge cap
4 Valve member
5 Valve retaining member
21 Inner layer body
22 Outer layer body
22*a* Mouth
22*b* Trunk
22*c* Sealing step portion
22*d* Male threaded portion
22*e* Through hole
22*f* Groove portion
31 Outer circumferential wall
31*a* Female threaded portion
32 Top wall
33 Discharge tube
33 Discharge outlet
34 Upper fitting groove
35 Ambient air introduction hole
36 Hinge
37 Cap body
37*a* Ceiling wall
38 Sealing wall
39 Lug portion
41 Base portion
42 Flange portion
43 Partition wall
44 Hinge portion
45 Valve body
46 Ambient air introduction valve
47 Projection
51 Partition wall portion
52 Outer tube portion
53 Retainer tube
54 Ring wall
54*a* Opening
55 Vent hole
56 Lower fitting groove
L Liquid reservoir space
S Containment space

The invention claimed is:

1. A discharge container comprising:

a double-walled container body including (i) an inner layer body which defines a containment space that contains a content containing some solid content and is deformable in a volume-reducing manner, and (ii) an outer layer body surrounding the inner layer body;

a discharge cap having a discharge outlet through which the content is discharged, the discharge cap being attached to a mouth of the double-walled container body; and a check valve structure which is disposed inside the discharge cap and allows a flow of the content from the containment space toward the discharge outlet and prevents backflow from the discharge outlet toward the containment space, wherein the check valve structure is provided as a valve member that has a tubular partition wall defining a flow path of the content from the containment space toward the discharge outlet and a valve body which is provided on the tubular partition wall with a hinge portion and has a single swing structure swung on the hinge portion, the valve member is retained inside the discharge cap by a valve retaining member having a partition wall portion that covers an upper opening of the inner layer body and a retainer tube hanging down from an inner peripheral edge of the partition wall portion, the tubular partition wall extends upward from an inside of the retainer tube, and a vertical length of the tubular partition wall is longer than a maximum diameter of the single swing structure, and the content has a viscosity such that, in a state in which the solid content prevents the valve body from achieving a completely closed state of the valve structure after discharge of a first portion of the content, a second portion of the content remains in a space inside the tubular partition wall that serves as a liquid reservoir space, the second portion of the content forming a liquid seal that restricts ambient air from reaching a third portion of the content that remains in the containment space.

2. The discharge container according to claim 1, wherein the viscosity of the content is 100 mPa·s or more.

3. The discharge container according to claim 2, wherein a diameter of a piece of the solid content contained in the content is less than 1.5 mm.

4. The discharge container according to claim 1, wherein a diameter of a piece of the solid content contained in the content is less than 1.5 mm.

5. The discharge container according to claim 1, further comprising a projection integrally provided at a central portion of an upper surface of the valve body, the projection adding to rigidity of the valve body.

6. The discharge container according to claim 1, wherein the inner layer body is formed of ethylene vinyl alcohol copolymer, nylon or polypropylene.

7. The discharge container according to claim 1, wherein the inner layer body is sandwiched between the outer layer body and the valve retaining member.

8. A discharge container comprising:

a double-walled container body including an inner layer body which defines a containment space for a content and is deformable in a volume-reducing manner and an outer layer body surrounding the inner layer body, the inner layer body being formed of ethylene vinyl alcohol copolymer, nylon or polypropylene;

a discharge cap having a discharge outlet through which the content is discharged, the discharge cap being attached to a mouth of the double-walled container body; and a check valve structure which is disposed inside the discharge cap and allows a flow of the content from the containment space toward the discharge outlet and restricts backflow from the discharge outlet toward the containment space, wherein the check valve structure is provided as a valve member that has a tubular partition wall defining a flow path of the content from the containment space toward the discharge outlet and a valve body which is provided on the tubular partition wall with a hinge portion and has a single swing structure swung on the hinge portion, the valve member is retained inside the discharge cap by a valve retaining member having a partition wall portion that covers an upper opening of the inner layer body and a retainer tube hanging down from an inner peripheral edge of the partition wall portion, the tubular partition wall extends upward from an inside of the retainer tube, and a vertical length of the tubular partition wall is longer than a maximum diameter of the single swing structure, and space inside the tubular partition wall above the valve body serves as a liquid reservoir space where part of remaining content is stored after the discharge of the content.

9. The discharge container according to claim 8, wherein the inner layer body is sandwiched between the outer layer body and the valve retaining member.

10. A discharge container comprising:

a double-walled container body including an inner layer body which defines a containment space for a content and is deformable in a volume-reducing manner and an outer layer body surrounding the inner layer body;

a discharge cap having a discharge outlet through which the content is discharged, the discharge cap being attached to a mouth of the double-walled container body; and a check valve structure which is disposed inside the discharge cap and allows a flow of the content from the containment space toward the discharge outlet and restricts backflow from the discharge outlet toward the containment space, wherein the check valve structure is provided as a valve member that has a tubular partition wall defining a flow path of the content from the containment space toward the discharge outlet and a valve body which is provided on the tubular partition wall with a hinge portion and has a single swing structure swung on the hinge portion, the valve member is retained inside the discharge cap by a valve retaining member having a partition wall portion that covers an upper opening of the inner layer body and a retainer tube hanging down from an inner peripheral edge of the partition wall portion, the tubular partition wall extends upward from an inside of the retainer tube, a vertical length of the tubular partition wall is longer than a maximum diameter of the single swing structure, the tubular partition wall, the valve body and the hinge portion are formed together as a single piece from a same material, and space inside the tubular partition wall above the valve body serves as a liquid reservoir space where part of remaining content is stored after the discharge of the content.

11. The discharge container according to claim 10, wherein the inner layer body is sandwiched between the outer layer body and the valve retaining member.

* * * * *